United States Patent [19]

Drews et al.

[11] 4,000,631

[45] Jan. 4, 1977

[54] RECEPTACLE DRIVE COUPLING FOR AN AUTOMATIC WASHER

[75] Inventors: Reinhold Alvin Drews; Frank Robert Burgener, Jr., both of Stevensville, Mich.

[73] Assignee: Whirlpool Corporation, Benton Harbor, Mich.

[22] Filed: Jan. 30, 1975

[21] Appl. No.: 545,261

[52] U.S. Cl. ..... 68/23.7; 403/371

[51] Int. Cl.[2] ..... D06F 23/04

[58] Field of Search ..... 68/23.6, 23.7, 131, 68/132, 133, 212, 23 R; 285/134, 323; 403/370, 371; 210/380 L

[56] References Cited

UNITED STATES PATENTS

| | | | |
|---|---|---|---|
| 1,796,062 | 3/1931 | Swanson | 285/323 X |
| 2,064,921 | 12/1936 | Kinsella et al. | 403/371 X |
| 2,147,239 | 2/1939 | Buchanan | 403/371 X |
| 2,202,679 | 5/1940 | Woodin | 68/133 X |
| 2,496,402 | 2/1950 | McVeigh et al. | 285/323 X |
| 3,009,747 | 11/1961 | Pitzer | 403/371 X |
| 3,257,830 | 6/1966 | Shelton | 68/133 |
| 3,563,575 | 2/1971 | Sanford | 285/323 |
| 3,678,714 | 7/1972 | Krolzick | 68/131 |

FOREIGN PATENTS OR APPLICATIONS

| | | | |
|---|---|---|---|
| 656,338 | 3/1965 | Belgium | 285/323 |

*Primary Examiner*—Philip R. Coe
*Attorney, Agent, or Firm*—Hill, Gross, Simpson, Van Santen, Steadman, Chiara & Simpson

[57] ABSTRACT

A receptacle drive coupling atop the spin drive tube in a washing machine assembly of the vertical axis type has a hollow drive block with a circumferential contact surface of reduced area on its downwardly flared lower part. A lock nut including a downwardly extending lower lip portion is threadedly received at the upper part of the drive block. A hollow center post of the receptacle is forced into proper alignment over the drive block by the lock nut and is firmly aligned with respect to the spin tube by the raised contact surface on the drive block and the lip portion of the lock nut.

8 Claims, 5 Drawing Figures

RECEPTACLE DRIVE COUPLING FOR AN AUTOMATIC WASHER

BACKGROUND OF THE INVENTION

1. Field of the Invention

This invention relates generally to vertical axis washing machines and more particularly to a receptacle coupling or mounting device.

2. Description of the Prior Art

Drive blocks of the general configuration of this invention are shown in applicant's U.S. Pat. No. 3,678,714. U.S. Pat. No. 3,257,830 shows a sleeve-like member which aligns the basket with the spin tube and which is mated to the spin tube and the basket by tightening a threaded ring about the upper portion of the sleeve.

SUMMARY OF THE INVENTION

The present invention provides an improved mounting and alignment system for the basket or receptacle of a washing machine of the vertical axis type. A perforated clothes basket or receptacle is mounted on the machine's spin drive tube over the drive block. The spin drive tube provides the basket with rotary drive when the washing machine is energized to spin the clothes load. The drive block, which is a coupling means provided for transferring rotary motion from the spin drive tube to the basket by way of the basket center post, is a hollow sleeve-like member flared downwardly at the bottom end and split through the wall from top to bottom along a vertical plane. The drive block further has a radially inwardly-extending circumferential collar at the top thereof for axially engaging the top portion of the spin tube; the collar has slotted axial openings for engaging corresponding upwardly-extending ears of the spin drive tube to effect a driving connection. The upper portion of the outer circumferential surface of the drive block is threaded to receive a lock nut. The hollow center post of the basket or receptacle slips over the drive block, and is of such configuration as to contact radially a raised circumferential contact surface provided at the lower outer periphery of the drive block. The lock nut has a tapered lower lip portion which wedges between an upwardly flared portion of the basket center post and the drive block and expands the space therebetween as it is tightened. As the lock nut is tightened, the drive block moves upwardly with respect to the basket and the split drive block tightens about the spin tube. At the same time, the drive block grips the basket center post with gradually increasing force and ultimately the basket is firmly aligned and held by the raised contact surface provided at the bottom of the drive block and by the tapered portion of the lock nut at the top of the drive block.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
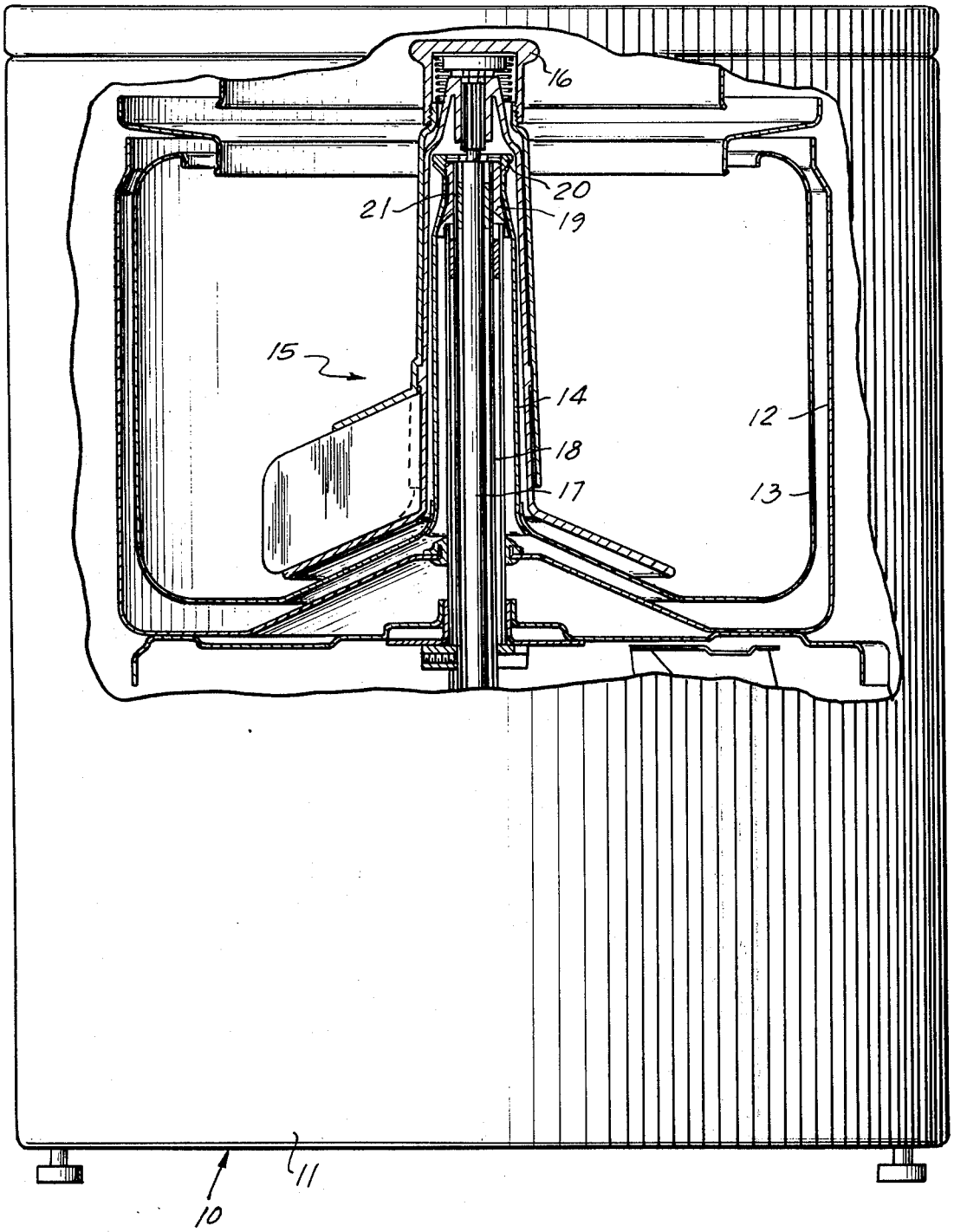
FIG. 1 is a general view of a vertical axis washing machine, showing generally the cabinet of the machine and by a cutaway section the tub, agitator, basket mounting assembly and interrelationships thereof.
Figure 2:
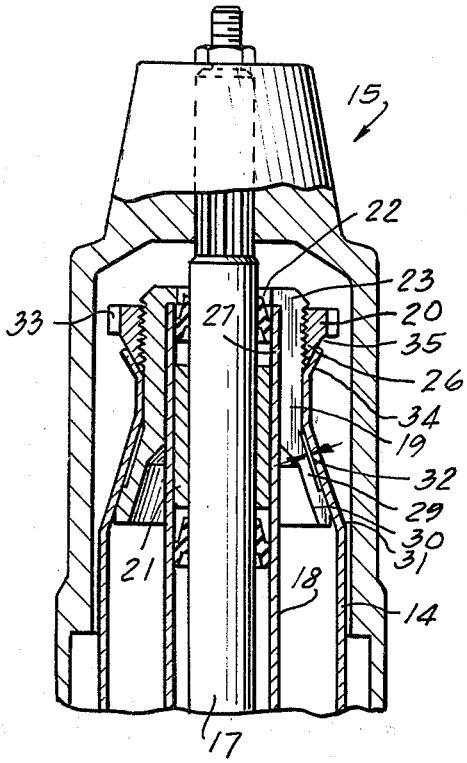
FIG. 2 is a fragmentary detailed cross-sectional view of the interior of the agitator shaft assembly showing the head of the spin tube, the mounting of the improved drive block and of the basket center post over the spin tube, the lock nut which positively mates the parts to one another, the agitator and drive shaft, and bearing and sealing members between the spin tube and the agitator drive shaft.

The present invention has a particular utility in a washing machine of the vertical axis type shown generally at 10 in FIG. 1. While such a machine may have either an overflow rinse type of receptacle or a perforated spin basket the exemplary disclosure herein described contemplates use of a perforated basket. Inwardly of the cabinet 11 is a cylindrical tub 12 within which the washing water is contained. Inwardly of the tub 12 is a perforated rotatable cylindrical basket 13 with an upwardly extending hollow center post 14 along the cylinder axis of the basket 13 and tub 12. Mounted about the center post 14 is an exemplary agitator assembly shown generally at 15 which is mounted to the washing machine through the cap 16. The cap 16 and the agitator 15 are driven by a drive shaft 17 along the cylindrical axis of the basket. Outwardly of the drive shaft 17 is a spin drive member in the form of a spin tube 18 over which is placed a drive body or drive block 19, the end of the center post 14 of the basket 13, and a lock nut 20 which when threaded over the drive block 19 will fasten the spin tube 18, the drive block 19, and the basket center post 14 into driving engagement. Bearing and sealing means between the agitator drive shaft 17 and the spin tube 18 may be provided as at 21.

Figure 5:
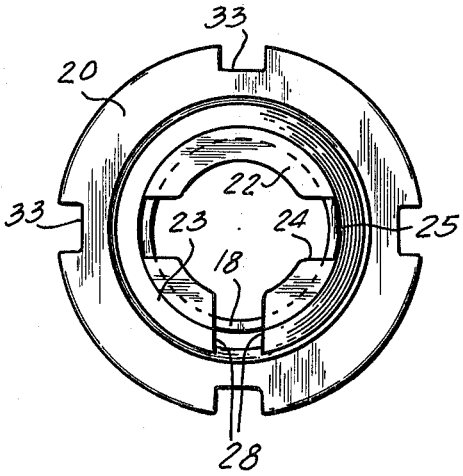
FIG. 5 is a cross-sectional view looking downward at line V—V of FIG. 3, showing the top of the drive block, the annular collar over the spin drive tube, and the lock nut.

The drive block 19 comprises a hollow body having an upper portion 23 and a lower portion 29. The upper portion 23 of the drive body or drive block 19 has an annular collar 22 as shown best in FIG. 5 to engage the upper end of the spin tube 18 to prevent relative axial motion between the tube and the drive body. The annular collar 22 is notched as at 24 to engage one or more ears 25 on the end of the spin tube 18 to prevent relative rotational movement between the tube 18 and the drive block 19.

The upper portion 23 of the drive block 19 is also provided with helical threads 26 on its exterior with which to engage the lock nut 20. The interior 27 of the upper portion 23 of the drive body 19 is cylindrical in radial cross-section and of such size as to fit snugly about the outer circumference of the spin tube 18.

The drive block 19 is slotted vertically at 28, from top to bottom. A lock nut 20 is threaded onto the drive block 19 at 26, to slightly compress the drive block 19 around the spin tube 18 to effect a substantially immovable connection thereto.

Figure 3:
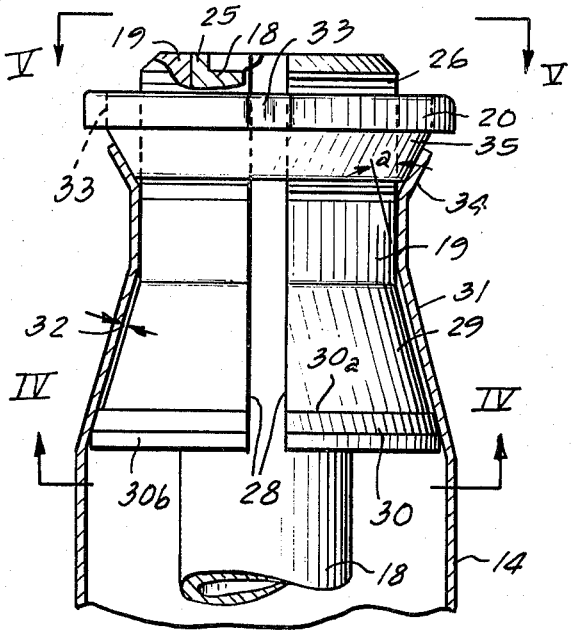
FIG. 3 shows more particularly the drive block with a raised circumferential contact surface provided about its lower periphery, and the basket center post, lock nut, and spin tube, including by a cutaway section a showing of an upwardly-extending ear from the spin tube.
Figure 4:
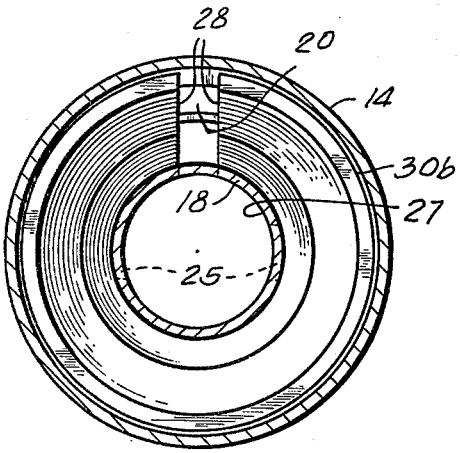
FIG. 4 is a cross-sectional view looking upward along the line IV—IV of FIG. 3, showing the bottom of the drive block.

The lower portion 29 of the drive block 19 is flared or tapered outwardly downward. Provided on its lower outer periphery is a circumferential contact surface 30 which is raised or embossed or otherwise formed to project outwardly a discrete distance sufficient to form an annular band of limited area. Such surface 30 is therefore presented to the bearing surface confronting it in immediate circumjacency as a uniform contact surface. The annular band 30 has an upper circumferential horizontal shoulder 30*a* and a lower circumferential vertically extending shoulder 30*b*. The raised contact surface 30 bears on the interior of the basket center post 14 at a corresponding downwardly-flared portion 31. In one embodiment which demonstrated the advantages of the invention, the downwardly-flared portion 31 of the basket center post and the contact surface 30 of the drive block were flared or tapered at an angle *a* of approximately 15° with respect to the vertical to provide parallel mating surfaces in those areas where raised contact surface 30 bears on the interior of the basket center post as shown in FIG. 3. The surface 30 raises or spaces the portion 31 away from the surface of the drive block 19 to create a gap or space as at 32 in FIG. 3 when the lock nut is threaded onto the drive block.

When the drive block 19 is placed over the spin tube 18 and the basket center post 14 is placed over the drive body, the lock nut 20 is threaded onto the upper end 23 of the body 19, as by means of gripping slots 33. A lower lip portion 35 of the lock nut 20 bears against the outwardly flared upper end 34 of the basket center post 14 and forces the basket center post 14 downward relative to the drive block 19. As the lock nut is threaded onto the drive block 19 the center post 14 of the basket or receptacle is firmly gripped by the contact surface portion of the body and the contact surface of the lock nut, and the inside surface of the body grips the spin drive tube in squeezing relationship to establish precise concentric horizontal and vertical alignment, prevent relative vertical movement, and ensure positive driving contact between the receptacle and the spin drive tube. Any objectionable cocking of the basket 13 is thereby precluded by the present invention. The gap 32, between the flared or tapered portion 29 of the drive block 19 and the downwardly flaring or tapering portion 31 of the basket center post, created by the annular circumferential contact surface 30 facilitates the seating of the basket center post 14 by eliminating any drive block and center post mismatch that could occur because of surface imperfections in either part and provides a more positive attachment area in comparison to prior art devices and assures that proper alignment is achieved between the basket 13 and the spin tube 18.

While minor modifications might be suggested by those versed in the art, it should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic washer having a receptacle including a hollow center post with a flared annular lip at the top of said center post and a downwardly flared portion below and spaced from said lip, and a spin drive member extending through said center post, drive block means for supporting said receptacle on said spin drive member and coupling said spin drive member in driving relationship to said receptacle, said drive block means comprising a hollow body having, a vertical slot through its side wall extending the length thereof, a substantially cylindrical upper portion including an inner surface and a threaded outer surface and having an inwardly-extending annular collar for engaging the top of the spin drive member, said collar including means for providing driving engagement between said drive block means and said spin drive member;

a downwardly-flared lower portion corresponding to the downwardly flared portion of the receptacle center post including a raised circumferential contact surface portion on the lower outer surface thereof; and a lock nut including a threaded inner surface for receiving the upper portion of the body and a downwardly tapered lower portion having an outer contact surface for engaging the lip of said receptacle center post, whereby as the lock nut is threaded onto the body the center post of the receptacle is firmly gripped by the contact surface portion of the body and the contact surface of the lock nut, and the inside surface of the body positively grips the spin drive member in squeezing relationship to establish precise alignment, prevent relative vertical movement, and ensure positive driving contact between the receptacle and the spin drive member.

2. In an automatic washing machine of the vertical axis type, the improvement of a receptacle coupling device, comprising:

a cylindrical drive body having an axis, an upper part, a flared lower part, and a projecting, circumferentially-extending contact surface about the outer periphery of said flared lower part, and a hollow receptacle center post outwardly flared downwardly below its top to correspond to the flare of said lower part of said drive body, to facilitate accurate alignment of the receptacle center post with respect to said axis of said drive body.

3. The receptacle coupling device of claim 2, further characterized by a lock nut threadedly received on said upper part of said drive body, said lock nut having a lower lip portion which forces the receptacle center post downwardly over said raised circumferential contact surface and into accurate alignment with said drive body axis when said lock nut is threaded onto said drive body.

4. In an automatic clothes washer of the vertical axis type having a rotatable receptacle for receiving clothes, said receptacle including a hollow center post with a flared annular lip at the top of said center post and a downwardly flared portion below and spaced from said lip, and a spin drive member extending through said center post, drive block means for supporting said receptacle on said spin drive member and coupling said spin drive member in driving relationship to said receptacle, said drive block means comprising a hollow body having, a vertical slot through its side wall extending along the length thereof;

a substantially cylindrical upper portion including an inner surface and a threaded portion on an outer surface thereof and having an inwardly-extending annular collar for engaging the top of the spin drive member, said collar including means for providing driving engagement between said drive block means and said spin drive member;

a downwardly-flared lower portion corresponding to the downwardly flared portion of the receptacle center post including a raised circumferential contact surface portion on the lower outer surface thereof; and a lock nut including a threaded inner surface for receiving the upper portion of the body and a downwardly tapered lower portion having an outer contact surface for engaging the lip of said receptacle center post, whereby when the lock nut is threaded onto the body the center post of the receptacle is firmly gripped by the contact surface portion of the body and the contact surface of the lock nut, and the inside surface of the body positively grips the spin drive member in squeezing relationship to establish precise alignment, prevent relative vertical movement, and ensure positive driving contact between the receptacle and the spin drive member.

5. In an automatic clothes washer as claimed in claim 4, wherein the contact surface portion of the drive block is concentric with the center post of the basket and the spin drive member.

6. In an automatic clothes washer as claimed in claim 4, wherein said spin drive member includes a projection from an upper portion thereof, and said annular collar member is notched to engage the projection to prevent relative rotational movement between the spin drive member and said drive block means.

7. In an automatic clothes washer as claimed in claim 4, wherein the downwardly flared portion of the hollow center post and the raised circumferential contact surface portion of said drive block means are tapered at approximately the same angle with respect to vertical.

8. In an automatic clothes washer as claimed in claim 7, wherein the downwardly flared portion of the hollow center post and the raised circumferential contact surface portion of said drive block means are tapered at an angle of approximately 15° with respect to vertical.

* * * * *